US009462892B2

(12) United States Patent
Piretti

(10) Patent No.: US 9,462,892 B2
(45) Date of Patent: Oct. 11, 2016

(54) CHAIR WITH A TILTING BACKREST

(71) Applicant: PRO-CORD S.p.A., Bologna (IT)

(72) Inventor: Giancarlo Piretti, Bologna (IT)

(73) Assignee: Pro-Cord S.P.A., Bologna (IT)

( * ) Notice: Subject to any disclaimer, the term of this patent is extended or adjusted under 35 U.S.C. 154(b) by 0 days.

(21) Appl. No.: 14/691,401

(22) Filed: Apr. 20, 2015

(65) Prior Publication Data

US 2015/0335160 A1 Nov. 26, 2015

(30) Foreign Application Priority Data

May 22, 2014 (IT) ..... TO2014A0407

(51) Int. Cl.
*A47C 7/44* (2006.01)

(52) U.S. Cl.
CPC ..... *A47C 7/443* (2013.01)

(58) Field of Classification Search
CPC ..... A47C 7/443
USPC ..... 297/301.4
See application file for complete search history.

(56) References Cited

U.S. PATENT DOCUMENTS 712,495 A * 11/1902 Chichester ..... A47C 7/443 297/301.4
755,991 A * 3/1904 Bolens ..... A47C 7/441 297/298
2,329,673 A * 9/1943 Wood ..... A47C 1/026 267/142
3,989,297 A 11/1976 Kerstholt
4,165,900 A 8/1979 Pesiri
4,858,993 A * 8/1989 Steinmann ..... A47C 1/026 297/302.4
7,118,177 B2 * 10/2006 Piretti ..... A47C 7/443 297/285
7,159,943 B2 * 1/2007 Costaglia ..... A47C 1/03255 297/301.4
7,198,328 B2 * 4/2007 Costaglia ..... A47C 1/03238 297/301.4
7,249,801 B2 * 7/2007 Tonin ..... A47C 7/445 297/289
8,113,586 B2 * 2/2012 Chen ..... A47C 1/026 297/301.1
8,714,646 B2 * 5/2014 Cvek ..... A47C 1/0242 297/217.3
8,998,321 B2 * 4/2015 Piretti ..... A47C 7/44 297/298
2008/0252124 A1 * 10/2008 Chen ..... A47C 7/443 297/301.4
2010/0084902 A1 * 4/2010 Fukai ..... A47C 1/032 297/301.1
2012/0274111 A1 * 11/2012 Piretti ..... A47C 7/443 297/301.4
2015/0374132 A1 * 12/2015 Bock ..... A47C 1/03255 297/303.4

FOREIGN PATENT DOCUMENTS

EP 2183997 A1 5/2010
GB 609242 9/1948
WO 2004075691 9/2004

OTHER PUBLICATIONS

Italian Search Report and Written Opinion dated Oct. 20, 2014 for Application No. TO2014A000407.

* cited by examiner

*Primary Examiner* — Timothy J Brindley
(74) *Attorney, Agent, or Firm* — Patterson & Sheridan, LLP

(57) ABSTRACT

A chair comprising: a base structure, a seat fixed to the base structure, a backrest, and a pair of oscillation joints which connect the backrest to the seat or to the base structure so as to allow tilting of the backrest around a transverse axis between a rest position and a backwardly tilted position, wherein each of said oscillation joints comprises: an essentially L-shaped rigid support a rigid lever articulated to the rigid support, and having a first and a second lever arm located on opposite sides with respect to the articulation axis, and an elastic device comprising a telescopic element and a compression spring, wherein the elastic device applies an elastic force between said rigid support and said first lever arm and wherein said second lever arm protrudes outwards from said rigid support and is fixed to a corresponding side edge of the backrest.

20 Claims, 7 Drawing Sheets

CHAIR WITH A TILTING BACKREST

CROSS-REFERENCE TO RELATED APPLICATIONS

This application claims benefit of Italian patent application number TO2014A000407, filed May 22, 2014, which is herein incorporated by reference.

BACKGROUND OF THE INVENTION

1. Field of the Invention

The present invention relates to a chair with a tilting backrest capable of tilting backwards under a thrust applied by the user's back.

2. Description of Prior Art

In the state of the art, there are various known solutions of chairs in which the backrest is connected to a fixed support structure by means of a pair of elastic joints, each of which comprises an upper support inserted into a tubular portion of the backrest, a lower support inserted into a tubular element of the fixed support structure and an elastic element, which allows an inclination between the upper support and the lower support.

For example, the document EP2183997 by the same Applicant describes a chair comprising a base structure including two rear tubular elements, a backrest having two tubular portions and two elastic devices, each of which has an upper support inserted into a tubular portion of the backrest, a lower support inserted into the corresponding tubular element of the base structure and an elastic element deformable by bending to allow an oscillation between the upper support and the lower support, wherein each of the elastic devices comprises a plurality of stacked sectors, arranged between the upper support and the lower support.

The elastic joints equipped with elastic elements that are deformable by bending have the drawback of a limited elastic force for opposing the backward thrust applied by the user. In principle, with elastic elements in compression formed, for example, by helical compression springs, it would be possible to increase the force provided by the elastic joints that contrast the backward thrust applied by the user on the backrest of the chair. However, with helical compression springs arranged coaxially to the side uprights of the backrest, the lever arm used for the compression of the springs would be limited.

Furthermore, the elastic joints usually require additional covering elements, such as bellows or the like. This penalizes the chair from an aesthetic point of view.

SUMMARY OF THE INVENTION

The present invention aims to provide a new chair with a tilting backrest which overcomes the problems of the prior art.

According to the present invention, this object is achieved by a chair with a tilting backrest having the characteristics forming the subject of claim 1.

The claims form an integral part of the disclosure provided in relation to the invention.

BRIEF DESCRIPTION OF THE DRAWINGS

The present invention will now be described in detail with reference to the attached drawings, given purely by way of non-limiting example, in which.

DETAILED DESCRIPTION

Figure 2:
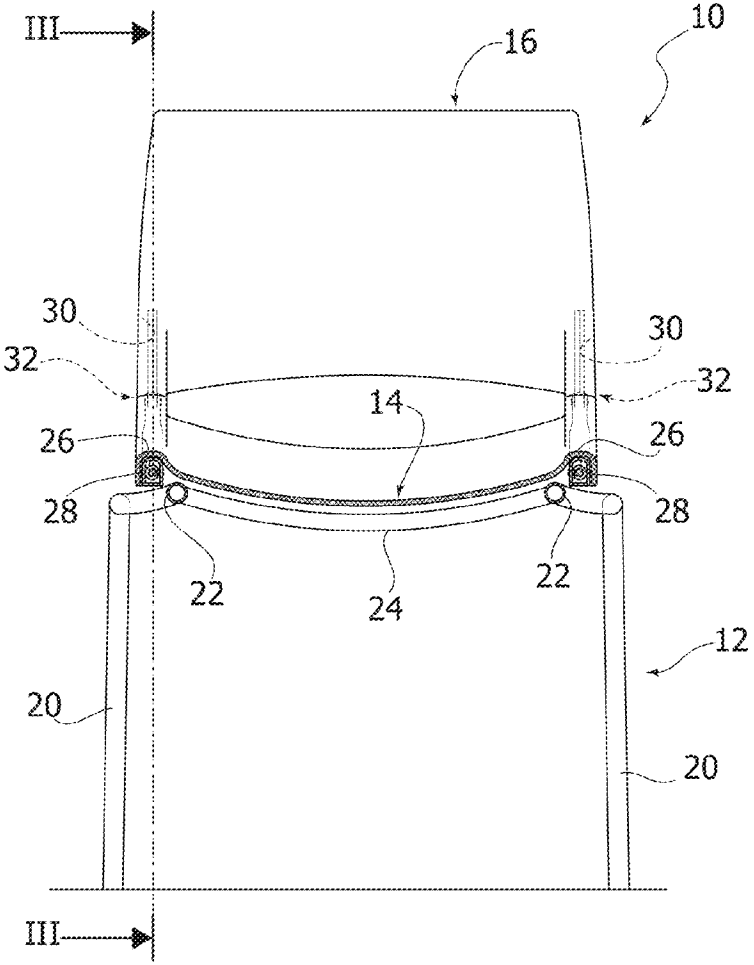
FIG. 2 is a front view according to the arrow II of FIG. 1.
Figure 1:
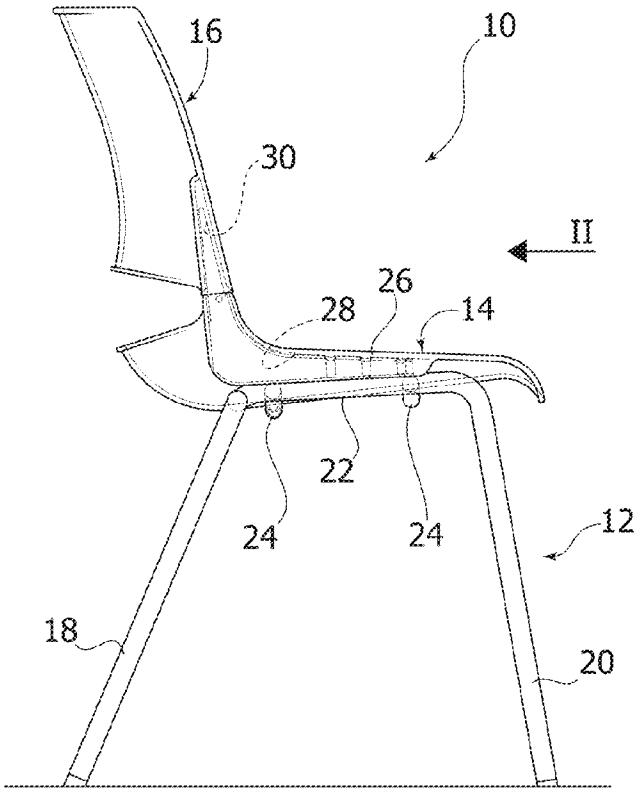
FIG. 1 is a side view of a chair according to the present invention.
Figure 4:
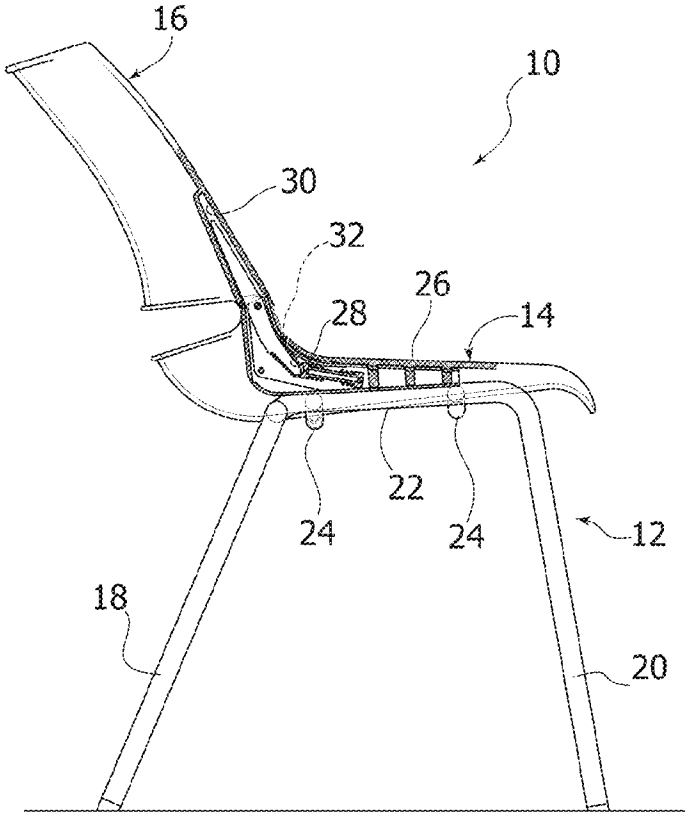
FIG. 4 is a cross-section analogous to FIG. 3 illustrating the chair with the backrest in the position of maximum backward tilt.
Figure 3:
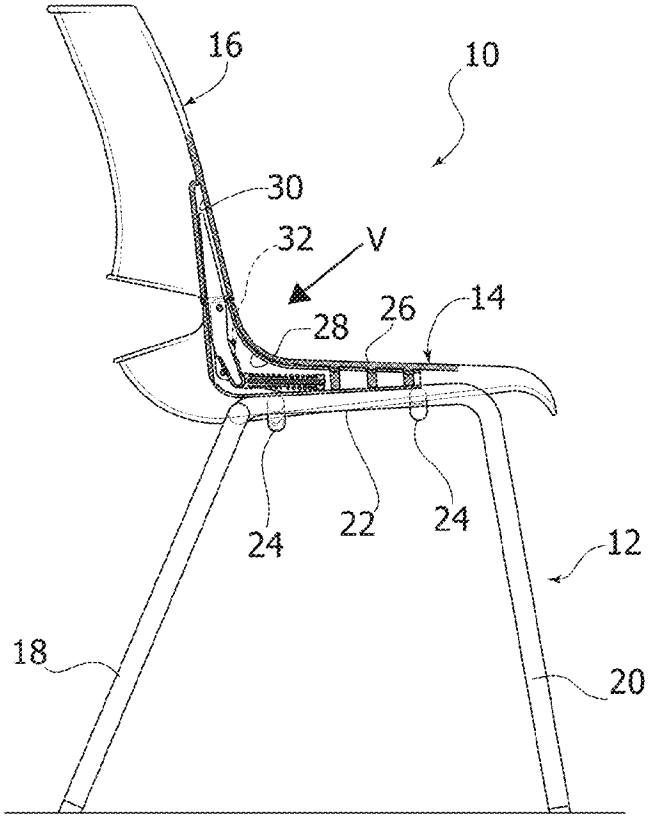
FIG. 3 is a cross-section according to the line III-Ill of FIG. 2.

With reference to FIGS. 1 to 5, the reference 10 indicates a chair with a tilting backrest according to the present invention. The chair 10 comprises a base structure 12, a seat 14 and a backrest 16. In the embodiment illustrated in the figures, the base structure 12 comprises a pair of rear legs 18 and a pair of front legs 20. The rear legs 18 are joined to the corresponding front legs 20 by means of upper longitudinal elements 22. The upper longitudinal elements 22 are fixed to each other by means of transverse connecting elements 24.

The seat 14 is preferably formed of a body made of injection-molded plastic material. The seat 14 has two downwardly-bent longitudinal edges 26 that form two hollow side housings 28. The seat 14 is fixed to the base structure 12 by any known way, for example by snap-fitting or screws.

The backrest 16 is preferably formed of a single panel of injection-molded plastic material, having an arcuate shape and equipped with two integral hollow seats 30 open at the bottom. The hollow seats 30 are located at the lower ends of the side edges of the backrest 16.

The chair 10 comprises two oscillation joints 32 which connect the backrest 16 to the seat 14 or to the base structure 12.

Figure 6:
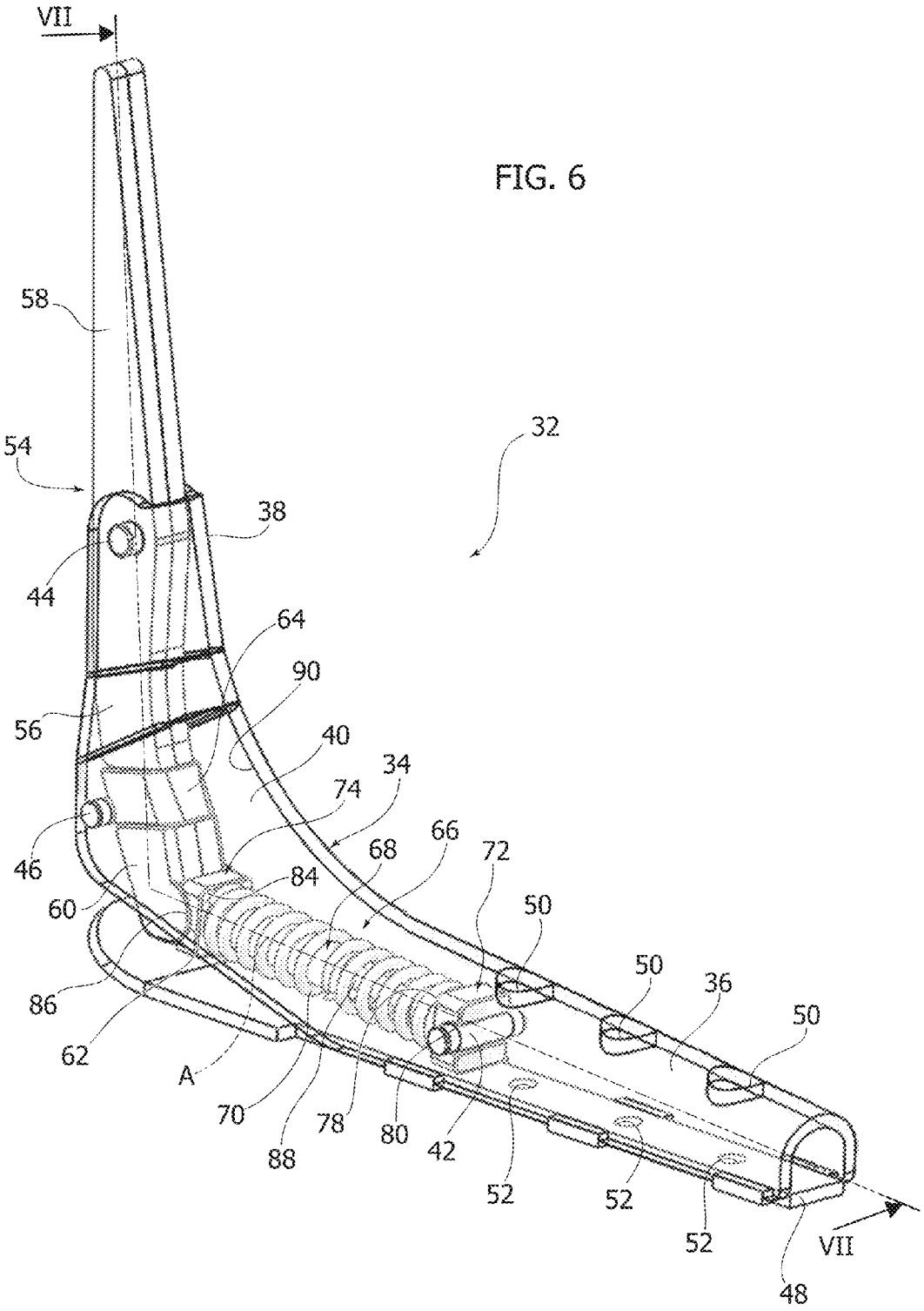
FIG. 6 is a perspective view in partial transparency of an oscillation joint indicated by the arrow VI in FIG. 5.
Figure 7:
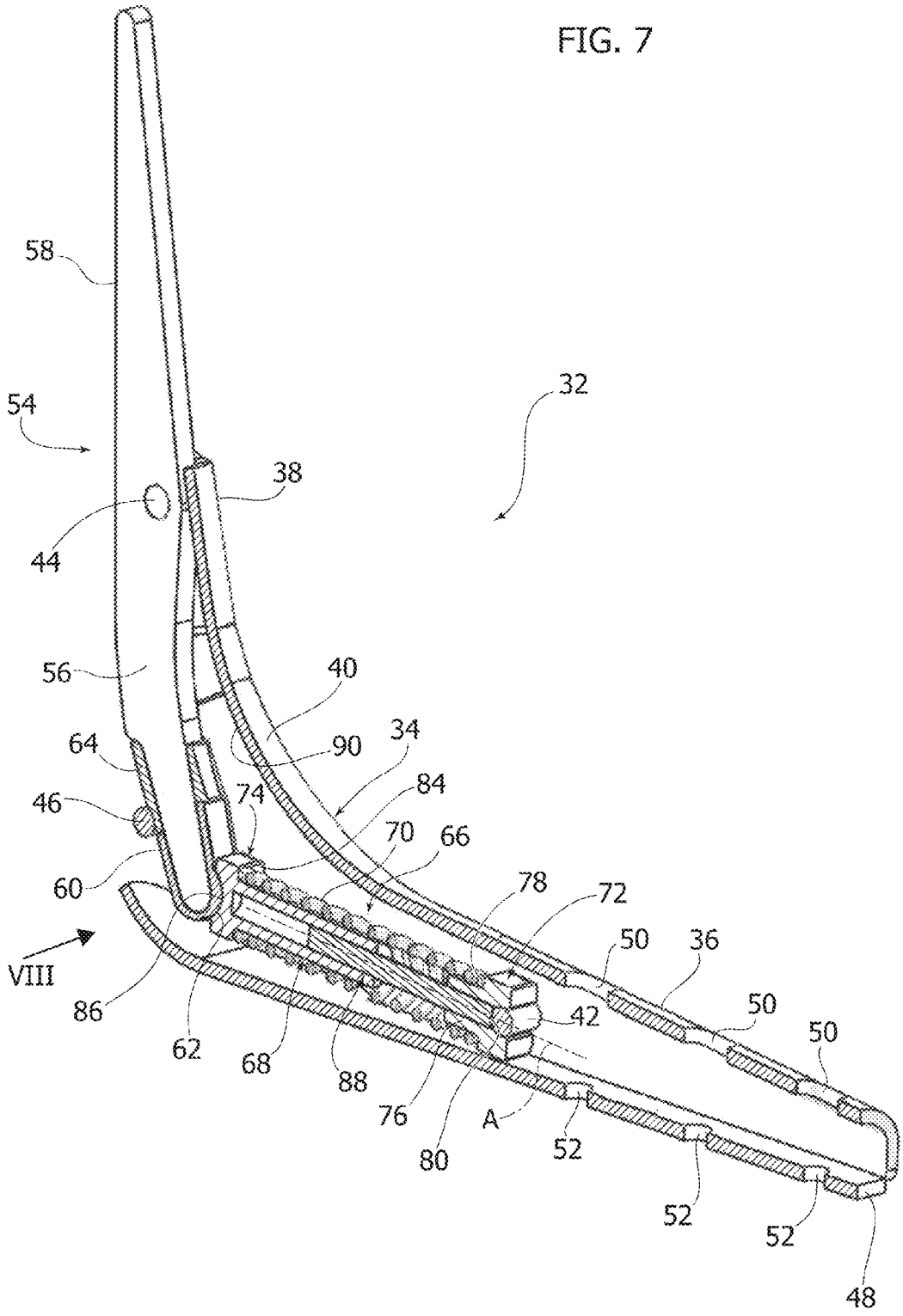
FIG. 7 is a perspective cross-sectional view according to the line VII-VII of FIG. 6.
Figure 8:
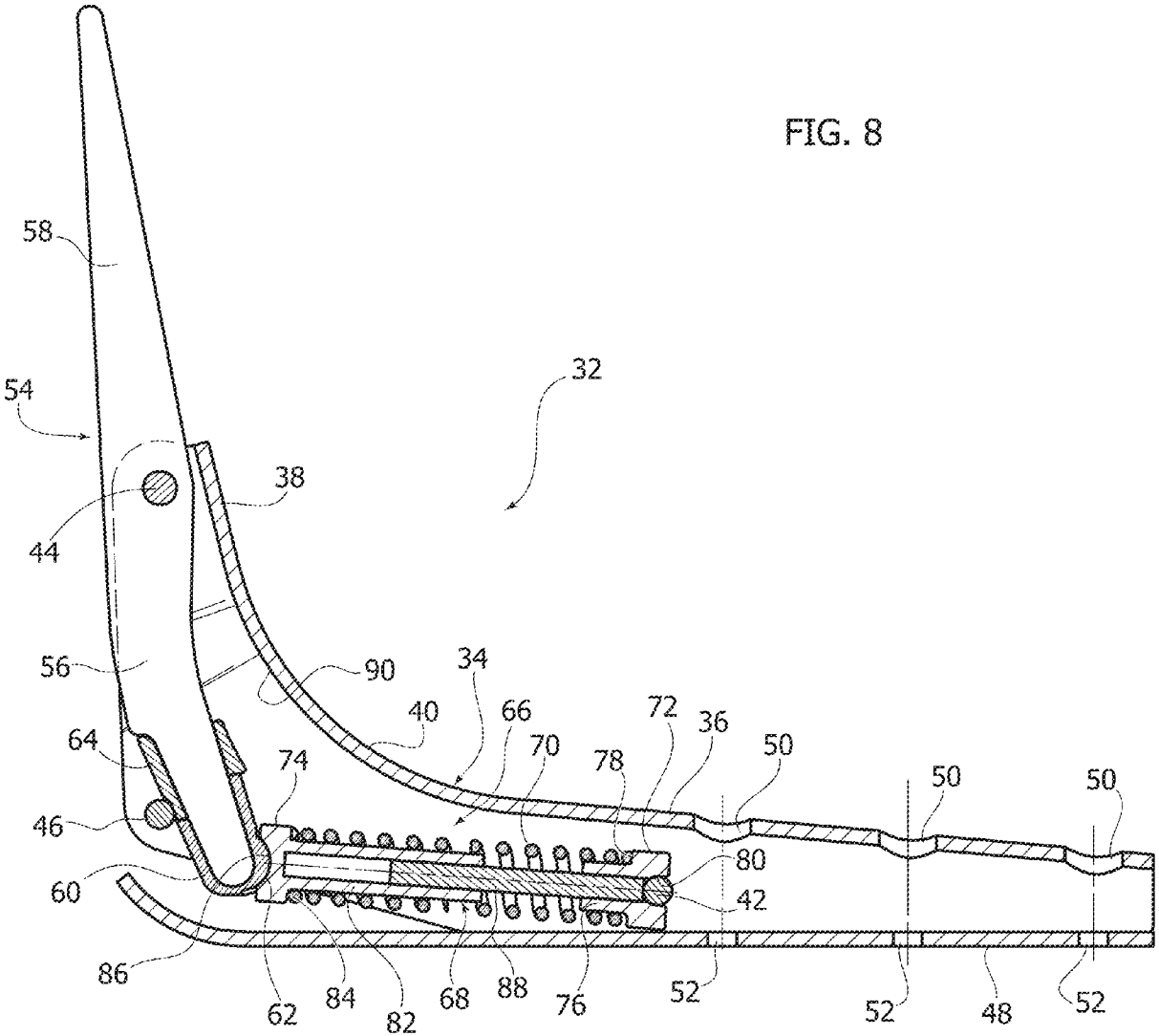
FIGS. 8 and 9 are cross-sectional views according to the arrow VIII of FIG. 7 illustrating the oscillation joint in the rest position and in the position of maximum backward tilt, respectively.

With reference to FIGS. 6 to 8, each oscillation joint 32 comprises a rigid support 34 consisting, for example, of pressed sheet metal. The rigid support 34 comprises a first arm 36 and a second arm 38 joined together by an arcuate portion 40. The two arms 36, 38 are essentially oriented at 90° to each other, so that the rigid support 34 is essentially L-shaped. In cross-section the first arm 36, the second arm 38 and the arcuate portion 40 are essentially U-shaped. The first arm 36, the second arm 38 and the arcuate portion 40 are preferably formed in a single piece.

The rigid support 34 carries a first transverse pin 42, a second transverse pin 44 and a third transverse pin 46. The pins 42, 44, 46 are parallel to each other and are fixed at their ends to opposite side walls of the rigid support 34. The first transverse pin 42 is located within the first arm 36, the second transverse pin 44 is located within the second arm 38 and the third transverse pin 46 is located within the arcuate portion 40. The rigid support 34 is preferably fitted with a closing element 48 fixed to the open edge of the first arm 36. The first arm 36 is equipped with a plurality of holes 50 aligned with corresponding holes 52 formed in the closing element 48.

Each oscillation joint 32 comprises a lever 54 articulated to the second arm 38 of the rigid support 34 by means of the second transverse pin 44. The lever 54 has a first lever arm 56 and a second lever arm 58 which extend from opposite sides relative to the second transverse pin 44. The lever 54 is rigid and is preferably formed of a single piece of metallic material. A body of relatively rigid plastic material 60 having a rounded head 62 can be applied to a distal end of the first lever arm 56. A sleeve of relatively soft plastic material 64 can be applied on a portion of abutment of the first lever arm 56. In the illustrated example, the sleeve of relatively soft plastic material 64 is located between one end of the body of relatively rigid plastic material 60 and a shoulder of the first lever arm 56.

Each oscillation joint 32 comprises an elastic device 66. The elastic device 66 comprises a telescopic element 68 and at least one compression spring 70, preferably formed by a helical spring. The telescopic element 68 comprises a first supporting body 72 and a second supporting body 74. The first and the second supporting bodies 72, 74 are preferably made of relatively rigid plastic material. The first support body 72 has a first tubular portion 76, a first shoulder 78 and a first semi-cylindrical seat 80. The second support body 74 has a second tubular portion 82, a second shoulder 84 and a second semi-cylindrical seat 86. The telescopic element 68 comprises a guide shaft 88 which slidably engages the first tubular portion 76 and the second tubular portion 82, so as to guide the second support body 74 with respect to the first support body 72 along a longitudinal axis A.

The first semi-cylindrical seat 80 of the first support body 72 engages the first transverse pin 42. The second semi-cylindrical seat 86 of the second support body 74 engages the rounded head 62 of the body of plastic material 60. The compression spring 70 has opposite ends that rest against the first shoulder 78 of the first support body 72 and against the second shoulder 84 of the second support body 74, respectively.

Figure 9:
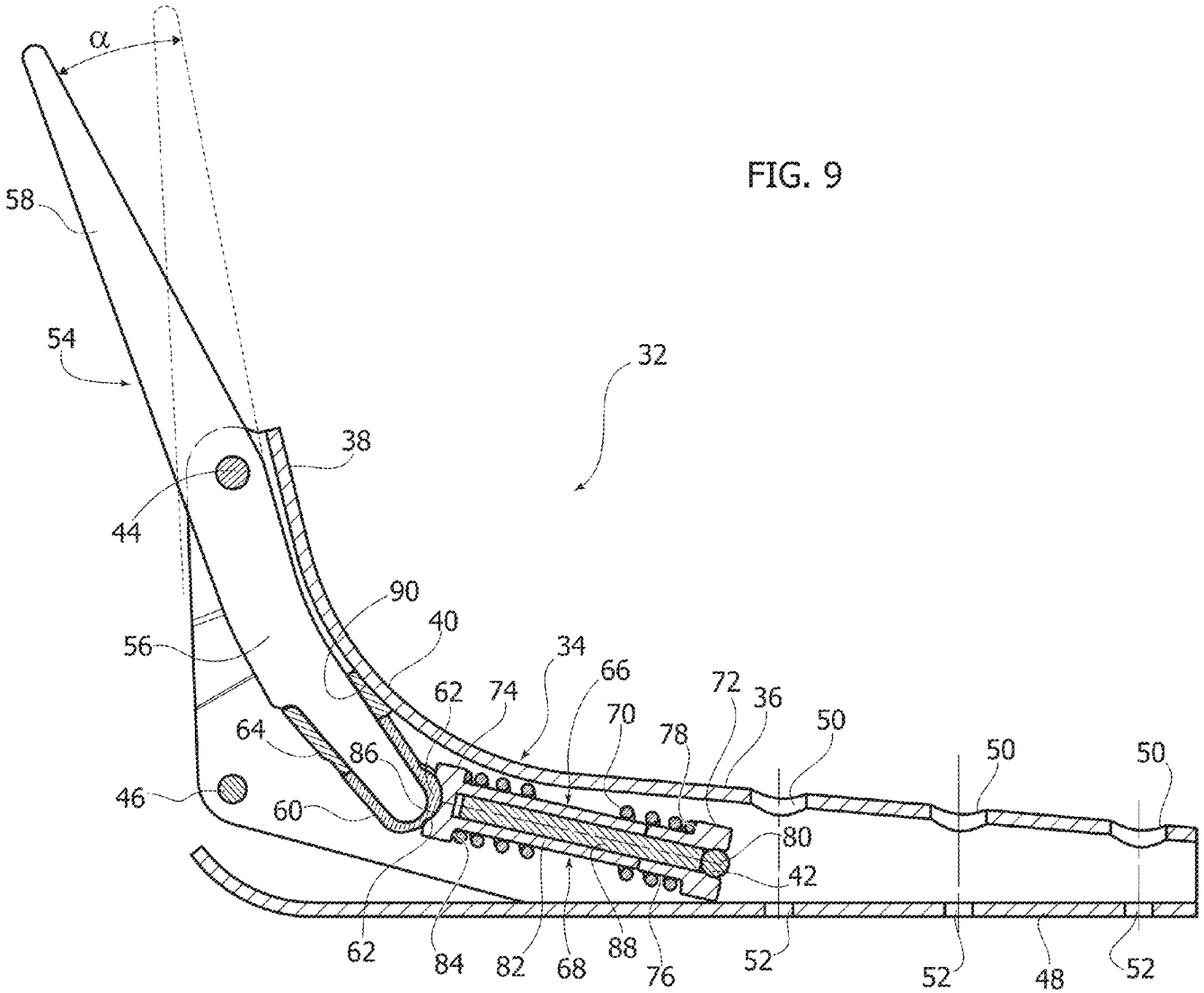

The elastic device 66 presses the first lever arm 56 against a first stop. In the illustrated embodiment, the first stop is formed by the third transverse pin 46. The lever 54 is capable of pivoting around the second transverse pin 44 between a rest position illustrated in FIG. 8 and a position of maximum backward tilt illustrated in FIG. 9. The angle of oscillation of the lever 54, indicated by a in FIG. 9, can be in the order of about 17°. During the pivoting of the lever 54 from the rest position to the position of maximum backward tilt, the spring 70 of the elastic device 66 is axially compressed and the elastic device 66 pivots around the first transverse pin 42. In the position of maximum backward tilt, the lever 54 abuts against a second stop 90, formed by a portion of the inner surface of the arcuate portion 40 of the rigid support 34. The sleeve of relatively soft plastic material 64 has the function of damping the contact between the first lever arm 56 and the stops 46, 90.

Each oscillation joint 32 is fixed to the seat 14 or to the base structure 12 in a position in which the first arm 36 of the rigid support 34 extends in the longitudinal direction and the second arm 38 of the rigid support 34 extends in the vertical direction. In the illustrated example, the rigid support 34 is fixed to the seat 14. Alternatively, the rigid support 34 may be fixed to the base structure 12.

Figure 5:
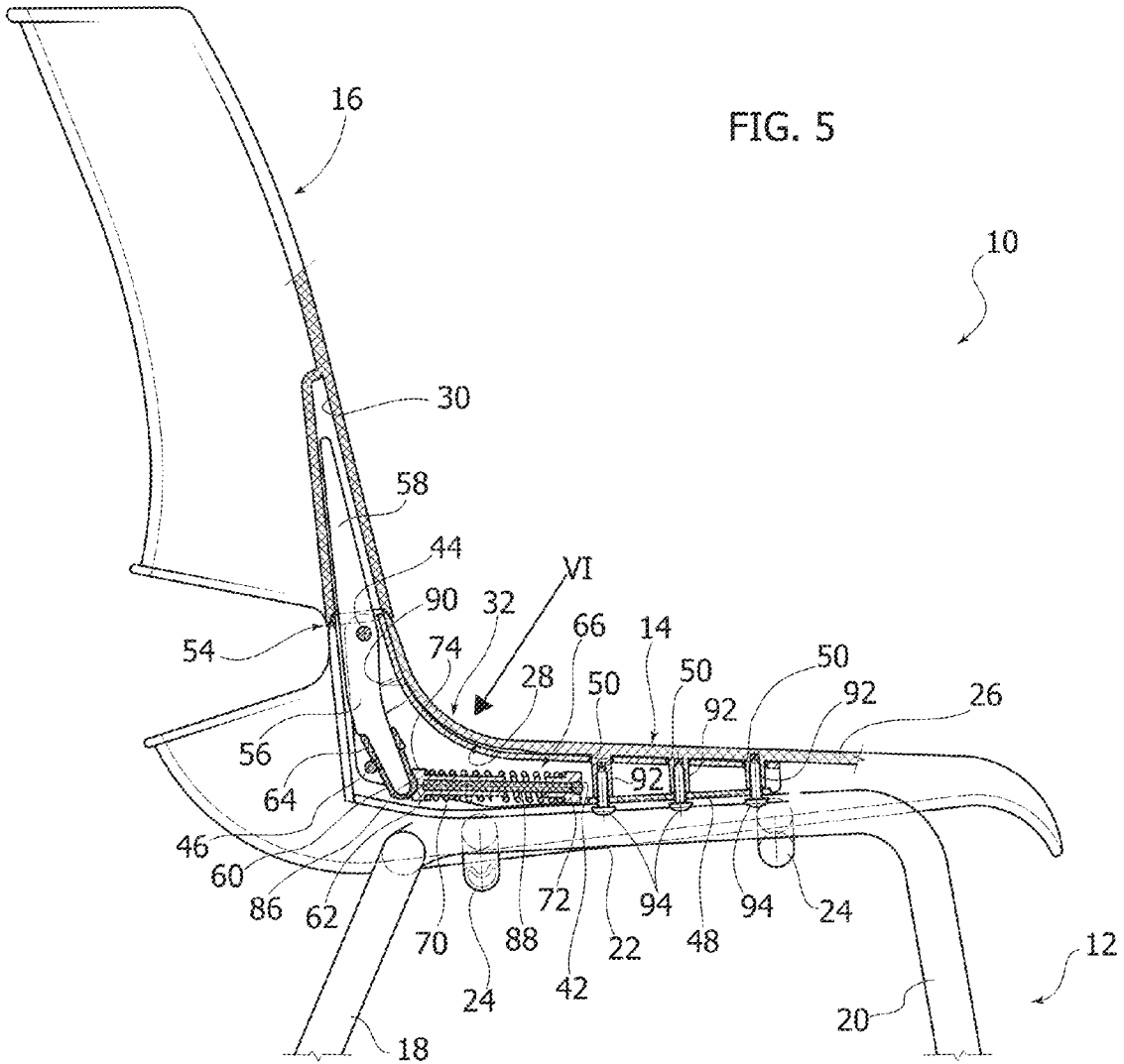
FIG. 5 is a cross-section on an enlarged scale of the part indicated by the arrow V of FIG. 3.

The rigid support 34 of each oscillation joint 32 is fixed within a corresponding hollow side housing 28 of the seat 14. With reference to FIG. 5, in the illustrated embodiment, each housing 28 is equipped with a plurality of perforated vertical pins 92 extending in the vertical direction and integrally formed with an inner wall of the housing 28. Each pin 92 is inserted within the first arm 36 of the rigid support 34 through a corresponding hole 50. The rigid support 34 is fixed to the seat 14 by means of self-tapping screws 94 which extend through respective holes 52 of the closing element 48 and engage the holes of the corresponding hollow pins 92 of the seat 14.

The second lever arm 58 of each oscillation joint 32 is inserted and fixed within a corresponding integral hollow seat 30 of the backrest 16. The fastening of the lever arm 58 within the respective seat 30 may be carried out by press-fitting or by means of screws, glue, etc. The second lever arm 58 projects upwardly from the upper end of the second arm 38 of the fixed support 34. The lower edge of the backrest 16 is essentially positioned in line with the upper end of the second arms 38 of the rigid supports 34. The hollow side housings 28 of the seat 14 have upwardly-bent rear portions covering the arcuate portions 40 and the second arms 38 of the rigid supports 34. In this way, the elastic joints 32 are completely contained within the hollow side housings 28 of the seat 14 and the hollow side seats 30 of the backrest 16. Therefore, the oscillation joints 32 are completely hidden from view. The oscillation joints 32 do not require the use of additional elements such as bellows or other coverings. The seat-backrest unit may be composed in order to appear as being formed by a single integral body instead of two separate elements as in normal chairs with tilting backrests.

Of course, without prejudice to the principle of the invention, the details of construction and the embodiments may be widely varied with respect to what is described and illustrated without departing from the scope of the invention as defined by the following claims.

The invention claimed is:

1. A chair comprising:

a base structure;

a seat fixed to the base structure;

a backrest, and a pair of oscillation joints which connect the backrest to the seat or to the base structure so as to allow tilting of the backrest around a transverse axis between a rest position and a backwardly tilted position, wherein each of said oscillation joints comprises:

a rigid support having a first and a second arm essentially arranged according to an L shape;

an elastic device comprising a telescopic element including a first support body and a second support body having respective tubular portions connected together in a slidable manner by means of a guide shaft, and a helical compression spring arranged coaxially to said tubular portions of said telescopic element, wherein the elastic device is arranged within said first arm of the rigid support;

a rigid lever articulated to said second arm of the rigid support around a transverse pin and having a first and a second lever arm located on opposite sides with respect to said transverse pin, wherein said second lever arm protrudes upwards from one end of said rigid support and is fixed to a corresponding side edge of the backrest and wherein said support body of the elastic device is elastically pressed against one end of said first lever arm so that the elastic device applies an elastic force between said rigid support and said first lever arm, wherein said rigid support has a first stop against which said lever rests in the rest position and a second stop against which said lever rests in the position of maximum backward tilt, and wherein the elastic device is pivotally connected to a second transverse pin on the rigid support at the first support body.

2. A chair according to claim 1, wherein the seat comprises two hollow side housings covering said rigid supports of said oscillation joints.

3. A chair according to claim 2, wherein said rigid support is equipped with holes within which integral pins are inserted, protruding from a surface of the respective hollow side housing of the seat, said pins being engaged by respective fastening screws.

4. A chair according to claim 1, wherein said lever carries a body of relatively rigid plastic material having a rounded head which cooperates with said second support body of the elastic device.

5. A chair according to claim 1, wherein said first lever arm carries a sleeve of relatively soft plastic material cooperating with said first stop and with said second stop.

6. The chair according to claim 1, wherein the lever is continuously free to oscillate with respect to the rigid support.

7. The chair according to claim 1, wherein the lever is continuously free to oscillate against the elastic force of the elastic device.

8. The chair according to claim 1, wherein the backrest is continuously free to tilt between the rest position and the position of maximum backward tilt.

9. A chair comprising:

a base structure;

a seat fixed to the base structure;

a backrest, and a pair of oscillation joints which connect the backrest to the seat or to the base structure so as to allow tilting of the backrest around a transverse axis between a rest position and a backwardly tilted position, wherein each of said oscillation joints comprises:

a rigid support having a first and a second arm essentially arranged according to an L shape;

an elastic device comprising a telescopic element including a first support body and a second support body having respective tubular portions connected together in a slidable manner by means of a guide shaft, and a helical compression spring arranged coaxially to said tubular portions of said telescopic element, wherein the elastic device is arranged within said first arm of the rigid support and wherein said first support body is articulated to said first arm of the rigid support;

a rigid lever articulated to said second arm of the rigid support around a transverse pin and having a first and a second lever arm located on opposite sides with respect to said transverse pin, wherein said second lever arm protrudes upwards from one end of said rigid support and is fixed to a corresponding side edge of the backrest and wherein said support body of the elastic device is elastically pressed against one end of said first lever arm so that the elastic device applies an elastic force between said rigid support and said first lever arm, wherein said rigid support has a first stop against which said lever rests in the rest position and a second stop against which said lever rests in the position of maximum backward tilt, and wherein the seat comprises two hollow side housings covering said rigid supports of said oscillation joints.

10. The chair according to claim 9, wherein said rigid support is equipped with holes within which integral pins are inserted, protruding from a surface of the respective hollow side housing of the seat, said pins being engaged by respective fastening screws.

11. The chair according to claim 9, wherein said lever carries a body of relatively rigid plastic material having a rounded head which cooperates with said second support body of the elastic device.

12. The chair according to claim 9, wherein said first lever arm carries a sleeve of relatively soft plastic material cooperating with said first stop and with said second stop.

13. A chair comprising:

a base structure;

a seat fixed to the base structure;

a backrest, and a pair of oscillation joints which connect the backrest to the seat or to the base structure so as to allow tilting of the backrest around a transverse axis between a rest position and a backwardly tilted position, wherein each of said oscillation joints comprises:

a rigid support having a first and a second arm essentially arranged according to an L shape;

an elastic device comprising a telescopic element including a first support body and a second support body having respective tubular portions connected together in a slidable manner by means of a guide shaft, and a helical compression spring arranged coaxially to said tubular portions of said telescopic element, wherein the elastic device is arranged within said first arm of the rigid support and wherein said first support body is articulated to said first arm of the rigid support;

a rigid lever articulated to said second arm of the rigid support around a transverse pin and having a first and a second lever arm located on opposite sides with respect to said transverse pin, wherein said second lever arm protrudes upwards from one end of said rigid support and is fixed to a corresponding side edge of the backrest and wherein said support body of the elastic device is elastically pressed against one end of said first lever arm so that the elastic device applies an elastic force between said rigid support and said first lever arm, wherein said rigid support has a first stop against which said lever rests in the rest position and a second stop against which said lever rests in the position of maximum backward tilt, and wherein said lever carries a body of relatively rigid plastic material having a rounded head which cooperates with said second support body of the elastic device.

14. The chair according to claim 13, wherein the seat comprises two hollow side housings covering said rigid supports of said oscillation joints.

15. The chair according to claim 14, wherein said rigid support is equipped with holes within which integral pins are inserted, protruding from a surface of the respective hollow side housing of the seat, said pins being engaged by respective fastening screws.

16. The chair according to claim 13, wherein said first lever arm carries a sleeve of relatively soft plastic material cooperating with said first stop and with said second stop.

17. A chair comprising:

a base structure;

a seat fixed to the base structure;

a backrest, and a pair of oscillation joints which connect the backrest to the seat or to the base structure so as to allow tilting of the backrest around a transverse axis between a rest position and a backwardly tilted position, wherein each of said oscillation joints comprises:

a rigid support having a first and a second arm essentially arranged according to an L shape;

an elastic device comprising a telescopic element including a first support body and a second support body having respective tubular portions connected together in a slidable manner by means of a guide shaft, and a helical compression spring arranged coaxially to said tubular portions of said telescopic element, wherein the elastic device is arranged within said first arm of the rigid support and wherein said first support body is articulated to said first arm of the rigid support;

a rigid lever articulated to said second arm of the rigid support around a transverse pin and having a first and a second lever arm located on opposite sides with respect to said transverse pin, wherein said second lever arm protrudes upwards from one end of said rigid support and is fixed to a corresponding side edge of the backrest and wherein said support body of the elastic device is elastically pressed against one end of said first lever arm so that the elastic device applies an elastic force between said rigid support and said first lever arm, wherein said rigid support has a first stop against which said lever rests in the rest position and a second stop against which said lever rests in the position of maximum backward tilt, and wherein said first lever arm carries a sleeve of relatively soft plastic material cooperating with said first stop and with said second stop.

18. The chair according to claim 17, wherein the seat comprises two hollow side housings covering said rigid supports of said oscillation joints.

19. The chair according to claim 18, wherein said rigid support is equipped with holes within which integral pins are inserted, protruding from a surface of the respective hollow side housing of the seat, said pins being engaged by respective fastening screws.

20. The chair according to claim 17, wherein said lever carries a body of relatively rigid plastic material having a rounded head which cooperates with said second support body of the elastic device.

* * * * *